United States Patent [19]

French

[11] Patent Number: 4,505,285

[45] Date of Patent: Mar. 19, 1985

[54] ADJUSTABLY VENTED UMBRELLA

[76] Inventor: Errol J. French, P.O. Box 1314, Chattanooga, Tenn. 37401

[21] Appl. No.: 399,714

[22] Filed: Jul. 19, 1982

[51] Int. Cl.[3] ..... A45B 11/00

[52] U.S. Cl. ..... 135/20 R; 135/35 V

[58] Field of Search ..... 135/35 R, 35 S, 35 V, 135/93, 20 R; 98/41 R

[56] References Cited

U.S. PATENT DOCUMENTS

| | | | |
|---|---|---|---|
| 312,446 | 2/1885 | Drake | 135/35 V |
| 617,415 | 1/1899 | Eatman | 135/35 V |
| 970,751 | 9/1910 | Pranke | 135/20 R |
| 1,428,343 | 9/1922 | Runcie | 135/93 |
| 2,466,851 | 4/1949 | Honerkamp et al. | 98/41 R |
| 4,023,582 | 5/1977 | Buzzella et al. | 135/20 R |
| 4,379,468 | 4/1983 | Szukhent, Jr. | 135/93 |

*Primary Examiner*—Robert A. Hafer
*Assistant Examiner*—Danton DeMille
*Attorney, Agent, or Firm*—Pitts and Brittian

[57] ABSTRACT

An umbrella suitable for mounting over a surface which allows selective venting of air trapped within the covered area is disclosed. The umbrella includes a vertical support structure (12) which comprises a rod (16) having a first end (20) and a further end (18). The further end (18) is conventionally mounted such that the longitudinal axis of the vertical support structure (12) extends substantially perpendicular to the covered surface. A canopy member (14) is carried by the first end of the vertical support structure and defines an opening (22) such that air currents flow through the opening (22) in an upwardly direction and heat may be readily dissipated from beneath the canopy (14). Also provided are mounting means (24) for holding the canopy member (14) at a preselected height while keeping the opening (22) as free from obstructions as is possible to allow fluid communication between the spaces above and below the canopy (14). A cover unit (44), which serves to prevent precipitation, particulate matter and the like from entering the covered area through the opening (22), is positioned at a preselected height above the opening (22). Also provided are means for adjustment (36) which support the cover unit (44) and allow adjustment of the vertical distance between the cover unit (44) and the canopy (14), thus permitting a controlled flow of air currents through the opening (22).

6 Claims, 5 Drawing Figures

ADJUSTABLY VENTED UMBRELLA

DESCRIPTION

Technical Field

This invention relates generally to umbrellas which are mounted over a surface desired to be covered and more particularly to apparatus which may be assembled for year-round use. In this particular invention, the umbrella includes unique methods and apparatus for allowing selective venting of air trapped beneath the covered area.

Background Art

Recreation facilities and restaurants commonly use umbrellas which are mounted over a surface to provide shaded areas where their customers may comfortably eat and relax. Such umbrellas also aid in keeping outdoor eating surfaces clean and dry. These umbrellas are well known in the art and typically include a central support structure which extends essentially perpendicular from the surface to be covered and carries at its distal end portion an umbrella body or canopy.

A drawback to these prior art umbrellas is that the canopies are usually closed, essentially domed structures which prevent the flow of air currents therethrough in an upwardly direction such that heat is trapped, causing discomfort to persons seated beneath the canopy. Moreover, known prior art canopies are typically structured of materials such as fabrics or metals which rapidly deteriorate, making the umbrellas unsuitable for use throughout the year or for extended periods.

Since it is desirable that heat under the canopy be readily dissipated, it is an object of the present invention to provide apparatus for adjustably venting the canopy without disturbing the canopy's primary function of protecting the area it covers.

Another object of the invention is to provide a canopy constructed of non-deteriorating material which can be left assembled throughout the year or for extended periods. Yet another object is to provide an umbrella which can be readily disassembled and reassembled as desired. Still a further object of the invention is to provide an umbrella which can be manufactured using a relatively inexpensive, uncomplicated process.

Disclosure of the Invention

Other objects and advantages will in part be obvious, and will in part appear hereinafter, and will be accomplished by the present invention which provides apparatus for providing a durable umbrella which can be selectively vented so as to dissipate heat from beneath the canopy. The umbrella comprises a vertical support structure which includes a rod having a first and further end. Also included is a means for mounting the further end so that the vertical support structure is supported substantially perpendicular to the surface to be covered. A canopy member, which is preferably unitary and defines an opening of preselected cross-sectional shape, is carried proximate the first end of the vertical support structure. The canopy is carried by the vertical support structure at a preselected height by mounting means which also preserve the venting function of the canopy opening. To maintain the protective function of the canopy, a cover unit is provided which includes a cover positioned at a preselected height above the opening. The cover has a perimeter at least equal to the effective opening defined by the canopy, and, in one embodiment, the cover has substantially the same shape as the opening. Also provided is a means for adjusting the vertical position of the cover with respect to the opening, thus permitting a controlled flow of air currents through the canopy opening in an upwardly direction to dissipate heat.

Brief Description of the Drawings

The above-mentioned features of the present invention will be more clearly understood from the consideration of the following description read in connection with the accompanying drawings in which.

Best Mode for Carrying Out the Invention

Figure 1:
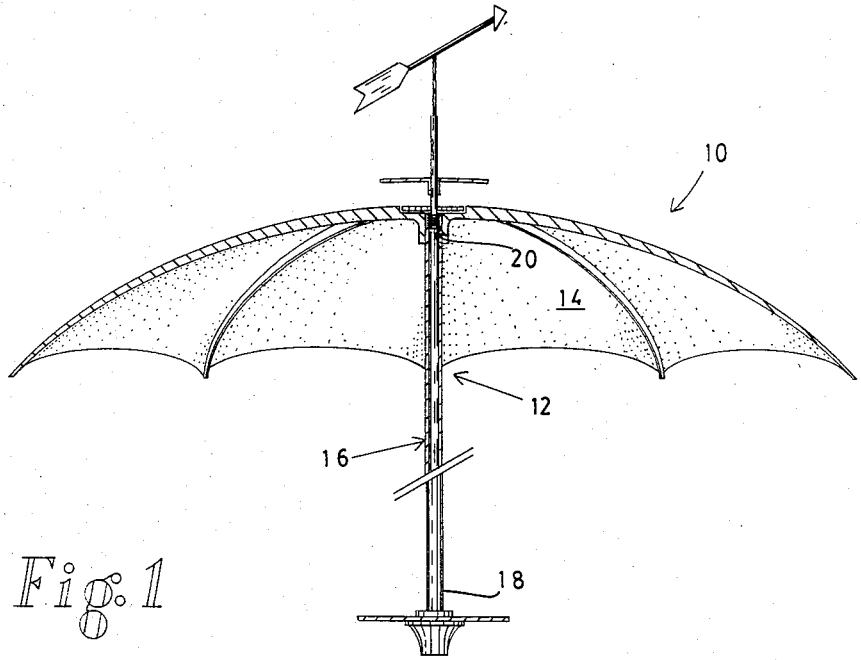
FIG. 1 is a cross-sectional view of an umbrella constructed in accordance with various features of the invention.

Referring now to the drawings, an umbrella constructed in accordance with various features of the present invention is illustrated generally at 10 in FIG. 1. The umbrella includes a vertical support structure 12 which comprises a rod 16 having a bottom end 18 and a top end 20. The rod 16 is fabricated from a suitable rigid material such as steel, aluminum or the like. More specifically, this rod 16 is substantially cylindrical and is hollow in the preferred embodiment so as to be lightweight and inexpensive to construct. The bottom end 18 is conventionally mounted such that the longitudinal axis of the vertical support structure 12 extends substantially perpendicular to the surface to be covered.

Support structure 12 serves to support the canopy 14 which is carried by the top end 20 of this structure 12. The canopy 14 is preferrably fabricated from a rigid material which in a preferred embodiment comprises fiberglass or the like which can withstand use for extended periods without deteriorating. This canopy 14 serves to shade and protect the area beneath it and it will be recognized by those skilled in the art that configurations other than the illustrated domed structure can be effectively used.

In one embodiment, for example, the canopy 14 is a unitary member molded to include a plurality of sections all of which are substantially in the form of isosceles triangles. These triangles are arranged in side-by-side relationship such that the bases substantially form a circle and the vertices opposite the bases meet or are positioned proximate the center of the canopy. The sides of each triangle constitute lines of intersection with the adjacent triangles, with the areas between the lines of intersection being arcuate recesses.

Figure 2:
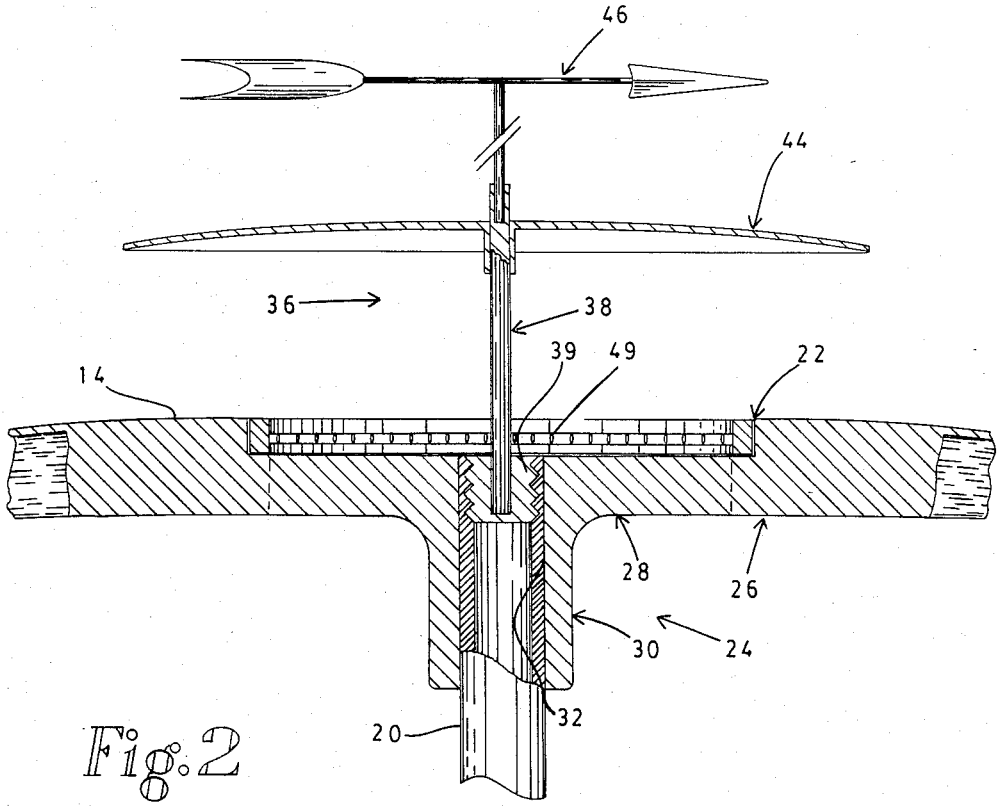
FIG. 2 shows, in a cross-sectional view, details of the adjustable venting structure.

As illustrated in the figures and more clearly in FIG. 2, the canopy 14 defines an opening 22 for purposes of allowing a flow of air currents in an upwardly direction therethrough, thus assisting to prevent a rise in temperature which is uncomfortable for persons seated beneath the canopy. The opening 22 is adapted for receiving a mounting means, shown generally at 24, which is designed to hold the canopy 14 at a preselected height while keeping the opening 22 as free as is feasible from components which might obstruct the fluid movement of air upward through the opening 22.

The canopy mounting means in the embodiment illustrated in FIG. 2 includes a collar member 26 which is secured to the rim of the canopy at the opening 22. This collar member 26 includes an inner and outer perimeter and is connected as by welding to a plurality of support arms 28. One end of each support arm is fixed to the collar member 26 at one end portion, with the opposite end portion being attached to a central hub 30 having a bore 32 therethrough. In the illustrated embodiment, the bore 32 includes a bottom portion with a substantially circular section and a top portion of reduced cross-section. The bottom portion serves as means for mounting the canopy 14 on the vertical support structure 12 and the top portion is provided for purposes of receiving the adjustment member to be discussed hereinafter.

It will be recognized that the mounting means as illustrated serves as a means for mounting the canopy and that alternate embodiments, such as a hub which is designed to receive the vertical support structure in a forced fitting relationship, could be used.

To maintain the protective value of the canopy, the umbrella includes a cover unit 44 which prevents precipitation, particulate matter and the like from entering the covered area through the opening 22 while allowing fluid communication between the surface above and below the canopy for purposes of dissipating the heat from the covered area. More specifically, the cover unit 44 in the illustrated embodiment in FIGS. 1 and 2 is a plate fabricated of rigid or semi-rigid material which serves to cover the opening in the canopy to prevent rain from entering the protected area. In the illustrated embodiment, the cover unit 44 defines a cross-sectional outline having substantially the same shape as the opening 22 and a perimeter greater than the inner perimeter of the collar member 26. To further protect the covered area, a wire mesh 49 (see FIG. 2) is attached to the support member in a preferred embodiment and serves to prevent wind blown matter from entering the covered area.

Means are provided for adjusting the vertical position of the cover unit 44 with respect to the opening 22. To this end, the adjustment means shown generally at 36 (see FIG. 2) serves to support the cover unit 44 over the opening 22 and allows the cover unit to be raised or lowered as needed or desired to regulate the air flow through the opening. The illustrated adjustment means includes an adjustment member 38 which is fixedly attached to the cover unit at one end portion 39. The opposite end portion is threadably received into the top portion of the bore 32 provided in the central hub of the canopy support member 24. Rotation of the adjustment member 38 thereby effects raising or lowering of the cover unit 44 with respect to the canopy 14. Also in the illustrated embodiment, the adjustment member 38 serves as a stand for a decorative weather vane 46.

Figure 3:
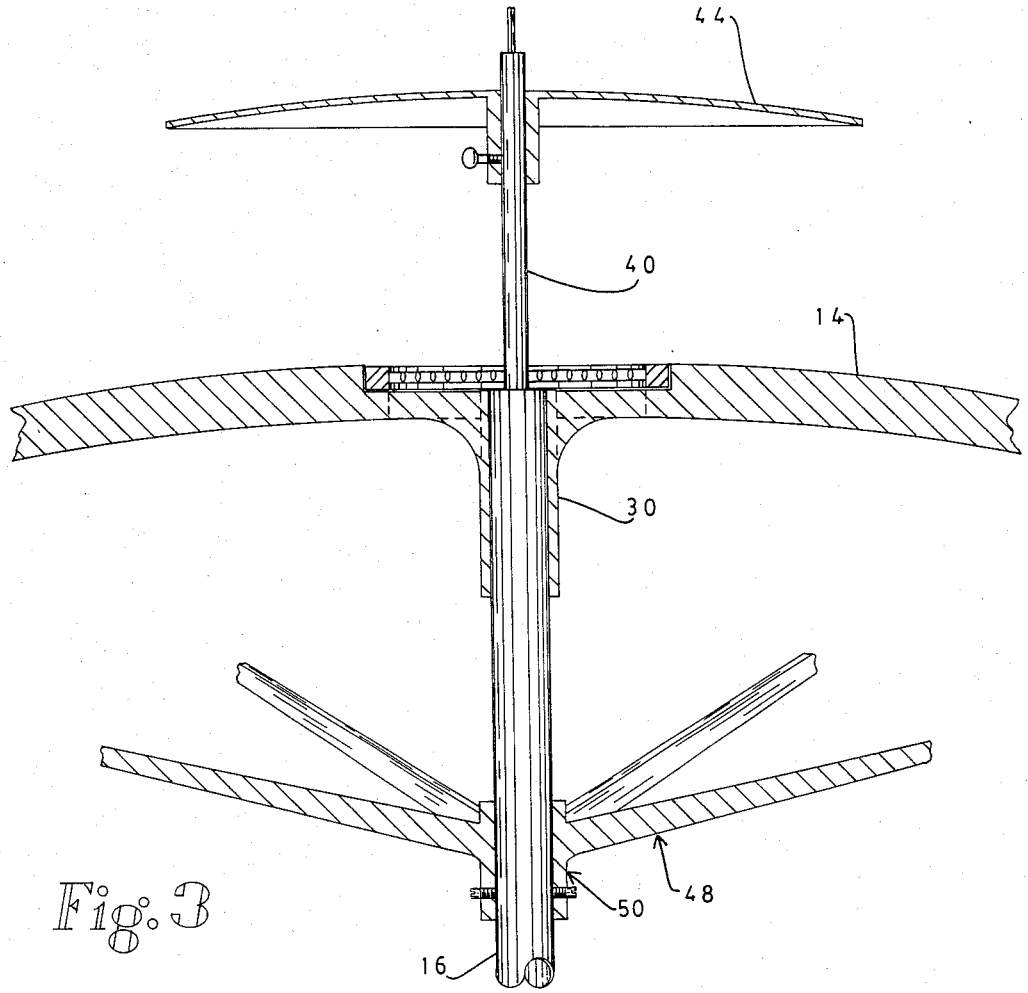
FIG. 3 is a cross-sectional view of an alternate embodiment of the vertical support structure which includes a plurality of support arms fixed to the canopy and further illustrates a sliding cover for the vent.
Figure 4:
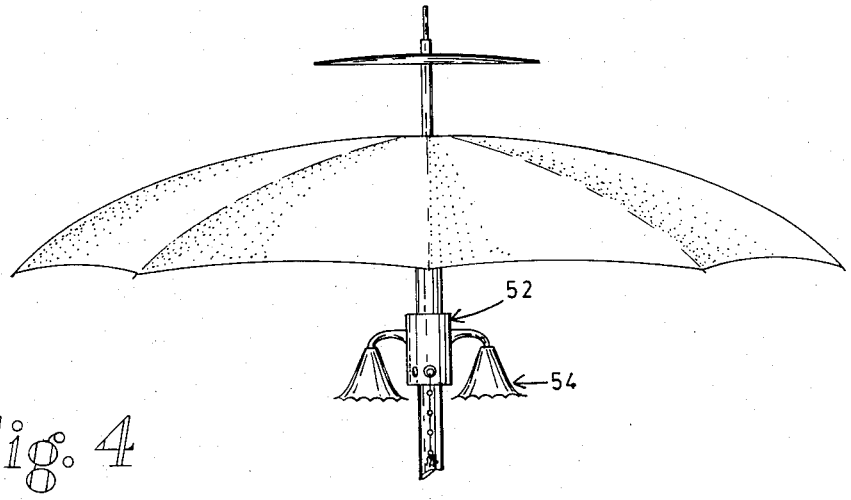
FIG. 4 shows an alternate embodiment of the vertical support structure which has a light fixture, a plurality of light bulbs and further illustrates an alternate embodiment of the adjustable venting structure which includes a sliding canopy which can be adjusted from below.

It will be recognized that other suitable means can be used to selectively control the flow of air currents through the canopy opening. As illustrated in FIG. 3, for example, the rod 40 which supports the cover unit 44 is a stationary member and an integral unit of the canopy mounting means 24. The cover unit 44 of this embodiment defines an opening and is adjustably secured to the stationary member by means of a set screw. FIG. 4 illustrates a further embodiment of the adjustment means in which the canopy is selectively moved along the longitudinal axis of the vertical support structure. In this embodiment, the cover unit 44 is fixedly attached to the first end of the rod of the vertical support structure 12. The canopy mounting means 24 is proportioned to slide along the longitudinal axis of the vertical support structure 12 and is secured at a selected height by at least one set screw. A major advantage of this embodiment is that the adjustment can be made by a person standing beneath the canopy.

FIGS. 3 and 4 also depict further embodiments of the vertical support structure. The embodiment in FIG. 3 includes a plurality of support arms 48 for purposes of supporting the canopy as necessary or desired, each arm having opposite ends. One end mounts on a central sleeve 50; the other end attaches to the canopy 14. FIG. 4 illustrates a further embodiment of the vertical support structure which includes a light fixture 52 and a plurality of light bulbs 54.

In one embodiment of the present invention (See FIG. 5), the mounting means for mounting the canopy 14 comprises upper and lower circular plate members 56 and 58, respectively, each having a cross-sectional diameter greater than the opening 22 in canopy 14. The lower plate member 58 is provided with a rod receptor 60 for closely receiving the rod 16, the rod 16 being secured in the receptor 60 by selectively tightening the set screw 62. The canopy 14 is mounted between the plate members 56 and 58, positioned such that the axis of the opening 22 is aligned with the axis of the plate members 56 and 58, the canopy 14 is secured between the plates 56 and 58 with the fasteners 64 which are received in registering holes (not shown) in the canopy 14 and the plate members 56 and 58.

To provide for the venting of air from beneath the canopy 14, the plate members 56 and 58 are provided with registering vent openings 66 which allow the passage of air. A circular vent adjuster disc 68 is rotatably mounted between the plates 56 and 58, the disc 68 being provided with openings 70 which slideably register with the openings 66 in the plate members 56 and 58 such that the vent adjuster disc 68 can be selectively rotated to place the openings 70 in a position to register with the openings 66 to allow the flow of air through the openings or rotated such that the openings 70 do not register with the openings 66, the disc 68 restricting the flow of air through the opening 66. To facilitate the selective positioning of the disc 68, the disc 68 is provided with manipulator members 72 positioned adjacent the openings 70 and extending downwardly through the openings 66 of plate member 58. In controlling the flow of air through the openings 58, the operator may thus grasp the manipulator members 72 and selectively and slideably rotate the disc 68 to the desired position.

Figure 5:
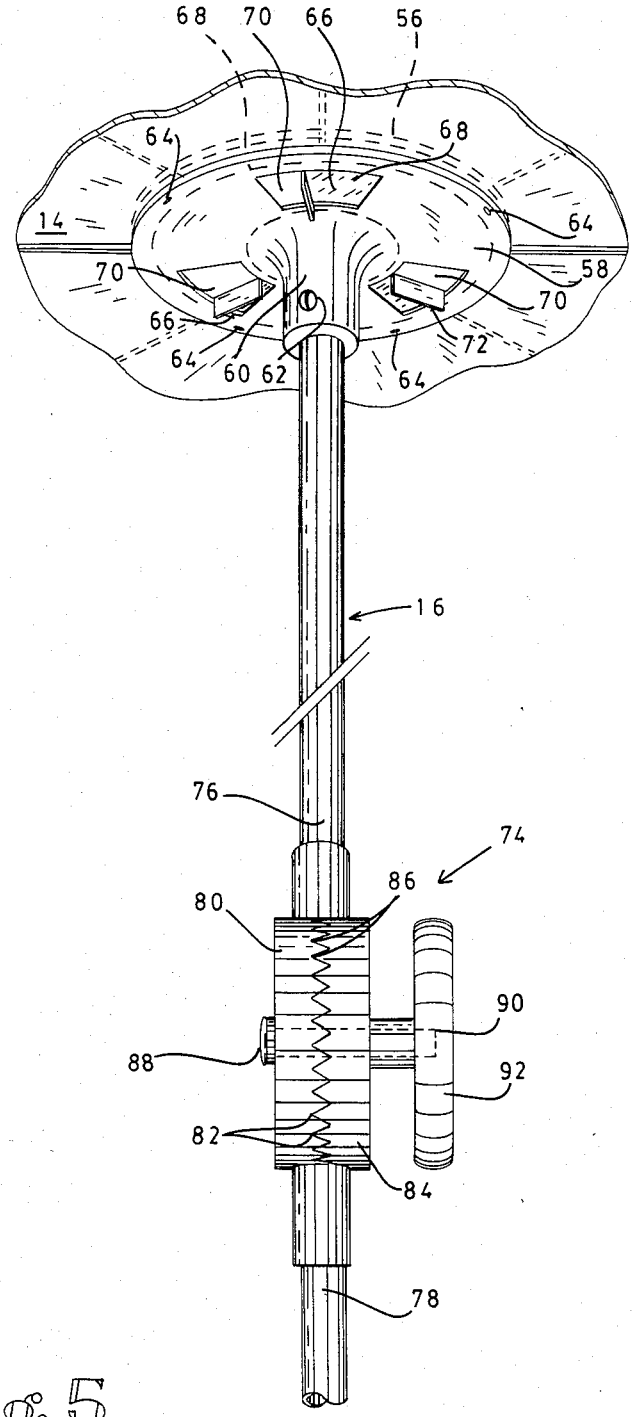
FIG. 5 depicts an alternate embodiment of the canopy mounting means which provides for selective venting of air from beneath the canopy and further illustrates an alternate embodiment of the vertical support structure which includes a pivot apparatus.

Still another embodiment of the umbrella of the present invention is provided with a pivot apparatus, illustrated generally at 74 of FIG. 5 for selectively tilting the canopy 14 to achieve the most advantageous positioning of the umbrella. In this embodiment, the rod 16 comprises upper and lower portions 76 and 78, respectively. The upper portion 76 carries a downwardly extending member having an inwardly facing surface carrying a plurality of radial teeth 82. The lower portion 78 carries an upwardly extending disc member having an inwardly facing surface carrying a plurality of radial teeth 86. The disc members 80 and 84 are provided with coaxially disposed holes receptive of the bolt 88, the bolt 88 being received in the threaded recess 90 of handle 92. Thus, the disc members 80 and 84 are positioned such that the radial teeth 82 and 86 can be made to mesh by tightening the handle 92 to hold the canopy in a desired position or the handle 92 may be positioned to allow the pivoting of the disc 80, and thus the tilting of the canopy 14, with the handle 92 being retightened to secure the canopy in a tilted position.

From the foregoing detailed description, it will be recognized that the disclosed umbrella incorporates certain advantages over the known prior art. For example, the umbrella is adapted for readily dissipating heat beneath the canopy by means of an opening in the canopy. Moreover, the flow of air through the opening in an upward direction can be controlled. In this connection, means are provided for adjusting the position of the cover unit 44 with respect to the illustrated generally at 74 of FIG. 5 for selectively tilting the canopy 14 to achieve the most advantageous positioning of the umbrella. In this embodiment, the rod 16 comprises an upper and lower portion 76 and 78 respectively, the upper portion 76 carries a downwardly extending member 80 having an inwardly facing surface carrying a plurality of radial teeth 82 and a lower portion 78 carrying an upwardly extending disc member having an inwardly facing surface carrying a plurality of radial teeth 86. The disc members 80 and 84 are provided with coaxially disposed holes receptive of the bolt 88, the bolt 88 being received in the threaded recess 90 of handle 92. Thus, the disc members 80 and 84 are positioned such that the radial teeth 82 and 86 be made to mesh by tightening the handle 92 to hold the canopy in a desired position or the handle 92 may be positioned to allow the pivoting of the disc 80, and thus the tilting of the canopy 14, with the handle 92 being retightened to secure the canopy in a tilted position.

From the foregoing detailed description, it will be recognized that the disclosed umbrella incorporates certain advantages over the known prior art. For example, the umbrella is adapted for readily dissipating heat beneath the canopy by means of an opening in the canopy. Moreover, the flow of air through the opening in an upward direction can be controlled. In this connection, means are provided for adjusting the position of the cover unit 44 with respect to the opening 22. Moreover, the umbrella is designed to be readily manufactured from available materials and can be assembled by unskilled workers. In one embodiment, a light carried by the support structure serves to selectively illuminate the area beneath the canopy. Further, asthetically pleasing features are incorporated into the umbrella, such as constructing the canopy with a plurality of juxtaposed isosceles triangle sections and providing the upper portion of the adjustment member 38 (see FIG. 2) with a weather vane.

Thus, although the present invention has been described with respect to specific methods and apparatus for providing an umbrella which may be selectively vented, it is not intended that such specific references be considered as limitations upon the scope of the invention except insofar as is set forth in the following claims.

I claim:

1. An umbrella suitable for being mounted above a surface to be protected while selectively venting air trapped beneath said umbrella, which comprises:

a rigid unitary canopy member having a lower surface directed toward said surface to be protected and an upper surface, said canopy defining a central circular opening and a circular perimeter concentric with said central opening, said upper surface of said canopy member being provided with a plurality of radial grooves extending from said central opening to said perimeter thereby dividing said canopy into a plurality of isosceles triangular sections each having a base at said perimeter and a truncated apex at said central opening;

a support rod having a first and a further end, said first end adapted for substantial vertical mounting from said surface to be protected;

mounting means proximate said further end of said rod for mounting said canopy concentric with said further end of said rod, said mounting means including a hub mounted on said rod, a ring concentric with said hub attached to said apex of said isosceles sections of said canopy and a plurality of web portions joining said ring to said hub for supporting said ring from said hub and defining air flow passages between said web portions;

an axial extension to said rod at said further end of said rod having a first end connected to said further end of said rod, and a further end;

a rigid unitary disk-shaped cover mounted on, and having a perimeter concentric with, said extension proximate said further end of said extension, said cover proportioned whereby said perimeter of said cover is at a greater radius from said rod than the radius of said central opening of said canopy; and means for selectively adjusting the spacing between said canopy and said cover to effect selecting the amount of air vented from beneath said canopy through said air flow passages.

2. The umbrella of claim 1 wherein said means for selectively adjusting said spacing comprises external threads on said first end of said extension and internal threads within said further end of said rod threadably engaged with said threads on said extension whereby axial rotation of said extension adjusts said spacing between said cover and said canopy.

3. The umbrella of claim 1 wherein said means for selectively adjusting said spacing comprises a radially oriented locking screw carried by said hub for releasable engagement with said rod whereby said hub can be selectively moved along said rod to a selected position for adjustment of said spacing.

4. The umbrella of claim 1 further comprising an adjustment unit interposed in said rod intermediate said first end and said further ends of said rod whereby angular orientation between the axis of said first end and the axis of said further end of said rod can be selectively adjusted to control tilting of said canopy and thus effect desired protection of said surface.

5. An umbrella suitable for being mounted above a surface to be protected while selectively venting air trapped beneath said umbrella, which comprises:

a rigid unitary canopy member having a lower surface directed toward said surface to be protected and an upper surface, said canopy defining a central circular opening and a circular perimeter concentric with said central opening, said upper surface of said canopy member being provided with a plurality of radial grooves extending from said central opening to said perimeter thereby dividing said canopy into a plurality of isosceles triangular sections each having a base at said perimeter and a truncated apex at said central opening;

a support rod having a first and a further end, said first end adapted for substantial vertical mounting from said surface to be protected;

mounting means proximate said further end of said rod for mounting said canopy concentric with said further end of said rod, said mounting means including a hub mounted on said rod, a ring concentric with said hub attached to said apex of said isosceles sections of said canopy and a plurality of web portions joining said ring to said hub for supporting said ring from said hub and defining air flow passages between said web portions;

an axial extension to said rod at said further end of said rod having a first end connected to said further end of said rod, and a further end;

a rigid unitary disk-shaped cover mounted on, and having a perimeter concentric with, said extension proximate said further end of said extension, said cover proportioned whereby said perimeter of said cover is at a greater radius from said rod than the radius of said central opening of said canopy; and means for selectively adjusting the spacing between said canopy and said cover to effect selecting the amount of air vented from beneath said canopy through said air flow passages, said means for adjusting said spacing including providing a threaded receptacle along the axis of said further end of said rod and external threads on said first end of said extension threadably engaged in said receptacle whereby axial rotation of said extension effects said selective spacing of said cover with respect to said canopy.

6. An umbrella suitable for being mounted over a surface to be covered while selectively venting air trapped beneath said umbrella, which comprises:

a rigid unitary canopy member having a lower surface directed toward said surface to be protected and an upper surface, said canopy defining a central circular opening and a circular perimeter concentric with said central opening, said upper surface of said canopy member being provided with a plurality of radial grooves extending from said central opening to said perimeter thereby dividing said canopy into a plurality of isosceles triangular sections each having a base at said perimeter and a truncated apex at said central opening;

a support rod having a first and a further end, said first end adapted for substantial vertical mounting from said surface to be protected;

mounting means proximate said further end of said rod for mounting said canopy concentric with said further end of said rod, said mounting means including a hub releasably attached to said rod, a ring concentric with said hub attached to said apex of said isosceles sections of said canopy and a plurality of web portions joining said ring to said hub for supporting said ring from said hub and defining air flow passages between said web portions;

an axial extension to said rod at said further end of said rod having a first end connected to said further end of said rod, and a further end;

a rigid unitary disk-shaped cover mounted on, and having a perimeter concentric with, said extension proximate said further end of said extension, said cover proportioned whereby said perimeter of said cover is at a greater radius from said rod than the radius of said central opening of said canopy; and means for selectively adjusting the spacing between said canopy and said cover to effect selecting the amount of air vented from beneath said canopy through said air flow passages, said means for adjusting said spacing including a threaded bolt radially penetrating said hub of said canopy support means for releasable contact with said rod whereby said hub can be moved to and fastened at selected positions along said rod to effect said selective spacing of said cover with respect to said canopy.

* * * * *